US010036619B2

(12) United States Patent
Fricke et al.

(10) Patent No.: US 10,036,619 B2
(45) Date of Patent: Jul. 31, 2018

(54) ARMOR-PIERCING CAVITATION PROJECTILE

(71) Applicant: Lehigh Defense, LLC, Quakertown, PA (US)

(72) Inventors: David B. Fricke, Quakertown, PA (US); Andrew Lorenzo, Quakertown, PA (US)

(73) Assignee: Lehigh Defense, LLC, Quakertown, PA (US)

( * ) Notice: Subject to any disclaimer, the term of this patent is extended or adjusted under 35 U.S.C. 154(b) by 2 days.

(21) Appl. No.: 14/993,026

(22) Filed: Jan. 11, 2016

(65) Prior Publication Data

US 2017/0199019 A1 Jul. 13, 2017

(51) Int. Cl.
*F42B 12/04* (2006.01)

(52) U.S. Cl.
CPC ..... *F42B 12/04* (2013.01)

(58) Field of Classification Search
CPC ..... F42B 30/02; F42B 12/06; F42B 12/08; F42B 10/24; F42B 10/08; F42B 12/04; F42B 10/22
USPC ..... 102/501, 510, 514, 507, 519, 517
See application file for complete search history.

(56) References Cited

U.S. PATENT DOCUMENTS 33,863 A * 12/1861 Woodberry ..... F42B 10/30 244/3.23
122,620 A * 1/1872 Maduell ..... F42B 12/34 102/506
216,974 A * 7/1879 Rice ..... F42B 12/34 102/506
221,249 A * 11/1879 Nowlan ..... F42B 12/34 102/506
534,352 A * 2/1895 Stuart ..... F42B 10/30 244/3.23
926,431 A * 6/1909 Luger ..... F42B 5/03 102/438
1,426,907 A * 8/1922 Ramsey ..... F42B 10/40 102/511
1,596,180 A * 8/1926 Henderson ..... F42B 10/24 102/499
1,732,211 A * 10/1929 Olin ..... B21K 1/025 102/514
1,746,397 A * 2/1930 Johnson ..... F42B 10/42 102/439
2,428,638 A * 10/1947 Scheiwer ..... F16L 37/23 137/614.04
2,507,878 A * 5/1950 Banning, Jr. ..... F41A 1/00 102/517
3,002,453 A * 10/1961 Fedor ..... F42B 10/46 102/382
3,165,058 A * 1/1965 Lahr ..... F42B 8/06 102/441
3,174,508 A * 3/1965 Zahuranec ..... F16L 37/23 137/614.04
3,186,342 A * 6/1965 Hancock, Jr. ..... F42B 7/10 102/523
3,200,751 A * 8/1965 Vitt ..... F42B 7/10 102/519

(Continued)

*Primary Examiner* — Troy Chambers
*Assistant Examiner* — Bridget A Cochran
(74) *Attorney, Agent, or Firm* — Fox Rothschild LLP

(57) ABSTRACT

A projectile has a body with an axis and a meplat disposed substantially orthogonal to the axis. The meplat is bounded by a substantially square edge.

18 Claims, 12 Drawing Sheets

(56) References Cited

U.S. PATENT DOCUMENTS 3,236,251 A * 2/1966 Hansen ..... F16L 37/23 137/614.05
3,245,348 A * 4/1966 Lahr ..... F41C 3/00 102/441
3,337,244 A * 8/1967 Appleberry ..... F16L 37/23 137/614.04
3,348,575 A * 10/1967 Simak ..... F16L 37/23 137/614.05
3,351,362 A * 11/1967 Hansen ..... F16L 37/23 285/277
3,848,532 A * 11/1974 Abbott ..... F42B 5/02 102/364
3,894,492 A * 7/1975 Barr ..... F42B 12/50 102/513
3,911,824 A * 10/1975 Barr ..... F42B 12/367 102/502
4,175,492 A * 11/1979 Knappworst ..... F42B 12/34 102/503
4,208,968 A * 6/1980 Hubsch ..... F42B 8/12 102/513
4,301,733 A * 11/1981 Arciniega Blanco ..... F42B 7/10 102/517
4,624,187 A * 11/1986 Bocker ..... F42B 10/46 102/501
4,644,866 A * 2/1987 Sullivan ..... F42B 7/10 102/439
4,685,706 A * 8/1987 Kowal ..... F16L 37/0925 285/322
4,829,904 A * 5/1989 Sullivan ..... F42B 7/10 102/439
4,829,906 A * 5/1989 Kaswer ..... F42B 12/34 102/508
5,097,767 A * 3/1992 Cirillo ..... F42B 10/46 102/506
5,116,224 A * 5/1992 Kelsey, Jr. ..... F42B 10/22 102/439
5,133,261 A * 7/1992 Kelsey, Jr. ..... F42B 10/22 102/439
5,144,979 A * 9/1992 Shobuzako ..... F16L 37/23 137/614.02
5,279,482 A * 1/1994 Dzenitis ..... B64G 1/648 102/504
D363,335 S * 10/1995 Dixon ..... F42B 8/06 D22/116
5,505,137 A * 4/1996 Godefroy ..... F42B 8/14 102/506
5,584,513 A * 12/1996 Sweeny ..... F16L 37/0925 285/243
5,683,120 A * 11/1997 Brock ..... F16L 37/0925 285/148.21
6,024,021 A * 2/2000 Schultz ..... F42B 12/74 102/506
6,363,856 B1 * 4/2002 Stoker, Jr. ..... F42B 10/48 102/507
6,453,820 B1 * 9/2002 Anderson ..... F42B 10/24 102/439
7,874,253 B2 * 1/2011 Marx ..... F42B 12/34 102/506
8,082,850 B2 * 12/2011 Marx ..... F42B 10/26 102/501
8,186,277 B1 * 5/2012 King ..... F42B 12/74 102/507
8,307,766 B2 * 11/2012 Marx ..... F42B 12/34 102/439
8,307,768 B2 * 11/2012 Cziglenyi ..... F42B 30/02 102/439
8,398,122 B2 * 3/2013 Crompton ..... F16L 37/091 285/315
9,052,174 B2 * 6/2015 Dennison ..... F42B 10/02
D748,220 S * 1/2016 Fricke ..... F42B 10/46 D22/116
9,366,512 B2 * 6/2016 Burczynski ..... F42B 14/00
9,534,876 B2 * 1/2017 Silvers ..... F42B 5/28
9,709,368 B2 * 7/2017 Mahnke ..... F42B 10/22
2004/0016357 A1 * 1/2004 Beal ..... F42B 10/46 102/519
2004/0050284 A1 * 3/2004 Piela ..... F42B 5/025 102/501
2006/0096491 A1 * 5/2006 Fichot ..... F42B 10/22 102/501
2006/0144280 A1 * 7/2006 Hirt ..... F42B 12/34 102/509
2007/0151474 A1 * 7/2007 Widener ..... F42B 10/24 102/501
2007/0235092 A1 * 10/2007 Danielson ..... F16L 37/23 137/614
2009/0288572 A1 * 11/2009 Sauvestre ..... F42B 5/045 102/439
2013/0056977 A1 * 3/2013 Henderson ..... E21B 17/046 285/325
2013/0214526 A1 * 8/2013 Annuzzi, Jr. ..... F41B 11/724 285/93
2014/0150682 A1 * 6/2014 Blin ..... F42B 10/46 102/519
2014/0216294 A1 * 8/2014 Tresserras Torre ..... F42B 6/10 102/517
2015/0059610 A1 * 3/2015 Amon ..... F42B 12/06 102/473
2015/0083011 A1 * 3/2015 Emary ..... F42B 12/02 102/506
2015/0308800 A1 * 10/2015 Schnabel ..... F42B 12/34 102/507
2016/0153757 A1 * 6/2016 Mahnke ..... F42B 10/22 102/501

* cited by examiner

ARMOR-PIERCING CAVITATION PROJECTILE

INTRODUCTION

Armor-piercing projectiles are typically used in military applications to penetrate metals, drywall, body armor, and other barriers. Supercavitation is the use of cavitation effects to create a bubble of gas inside a liquid large enough to envelope an object travelling through the liquid, greatly reducing the skin friction drag on the object and enabling achievement of very high speeds. Supercavitation is typically utilized in torpedoes and high velocity air-to-water projectiles that are used, e.g., to detonate mines. In water, cavitation occurs when water pressure is lowered below the water's vapor pressure, thus forming bubbles of vapor around the object, thus reducing skin friction.

SUMMARY

In one aspect, the technology relates to a projectile having a body having an axis and a meplat disposed substantially orthogonal to the axis, wherein the meplat is bounded by a substantially square edge. In an embodiment, the body has a body tail surface disposed opposite the meplat and a nose extending from the meplat towards the body tail surface, wherein the nose has a frustum having substantially curved surfaces. In another embodiment, the nose terminates at a substantially round collar. In yet another embodiment, the body comprises a body ogive radius and the collar comprises a collar ogive radius substantially the same as the body ogive radius. In still another embodiment, the body further comprising a neck disposed between the collar and the body, wherein the neck comprises a diameter less than a diameter of the collar. In another embodiment, the body defines a groove reference curve spanning from the body to the collar, wherein the groove reference curve is identical to the body ogive radius.

In another aspect, the technology relates to a projectile having a body and a nose, wherein the nose has a frustum and a meplat, and wherein an outer edge of the meplat is at least partially defined by a plurality of corners. In an embodiment, the frustum comprises at least three surfaces extending from the meplat. In another embodiment, the frustum comprises a plurality of curved surfaces extending from the meplat. In yet another embodiment, the nose terminates at a collar, wherein an outer edge of the collar is at least partially defined by a circular outer edge. In still another embodiment, the projectile comprises a total projectile length and the nose comprises a nose length of about 25% to about 35% of the total projectile length.

In another embodiment of the above aspect, the nose length is about 27.5% of the total projectile length. In an embodiment, a neck connecting the body and the nose, and wherein the body and the nose define a groove substantially surrounding the neck. In another embodiment, the neck comprises a neck length of at least about 10% of the total projectile length. In another aspect, the technology relates to a projectile having: an axis; a total projectile length measured along the axis; a nose having a collar; a body having a body tail surface; and a neck connecting the nose and the body, wherein the neck has a neck diameter of about 80% of a diameter of the collar, and wherein the nose and the body define a groove therebetween wherein the groove has a groove length of at least about 10% of the total projectile length. In an embodiment, the nose comprises a meplat having an angular outer edge. In another embodiment, the body comprises a body ogive radius and defines a reference curve spanning the groove, wherein the reference curve further extends from the collar to the axis, and wherein the reference curve comprises a reference curve radius identical to the body ogive radius. In yet another embodiment, the nose is substantially contained within the reference curve. In still another embodiment, the nose is contained within the reference curve. In another embodiment, the body tail surface at least partially defines a concave recess.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Supercavitation phenomena exists at transonic, and to a lesser degree subsonic, velocities in high moisture mediums such as water, ballistic gel and tissue. Projectiles launched from handheld firearms, such as rifles or handguns, can utilize the technologies described herein so as to form a cavitation bubble about the projectile at 1,500 fps in 10 percent ballistic gel. Cavitation may also occur at lower velocities due to the unique nose and body geometries described herein. The air/vapor barrier blanketing the sides of the projectile reduces the skin friction, thus allowing the projectile to lose velocity less quickly once in a wet target. The nose design also radiates the pressure wave outwards, creating tissue damage beyond the maximum outside diameter of the projectile. Another design characteristic includes a groove behind the nose that minimizes the nose's ability to create water vapor, and acts as an air reservoir allowing the air to be pulled from this area to aid in blanketing the projectile surface.

In addition to supercavitation, the projectile described herein also utilize technologies that make them barrier-blind, even at subsonic speeds. In examples, the meplat of the nose is defined by a perimeter having a number of sharp corners, as opposed to the substantially circular designs more typically present in the prior art. These meplats bounded by straight surfaces, corners, and otherwise angular perimeters, reduce the hoop strength of material that comes in contact with the projectile. This allows the projectile to lose less velocity and thus overcome these barriers. Through testing, it has been determined that at 1,500 fps, a 90 gr, 9 mm projectile manufactured in accordance with the technologies described herein can penetrate a Kevlar Army Modular Helmet System, which is rated to stop 9 mm ammunition at 1,600 fps. Once through any intervening barriers, the supercavitation allows for deep penetration into a wet target.

Figure 1A:
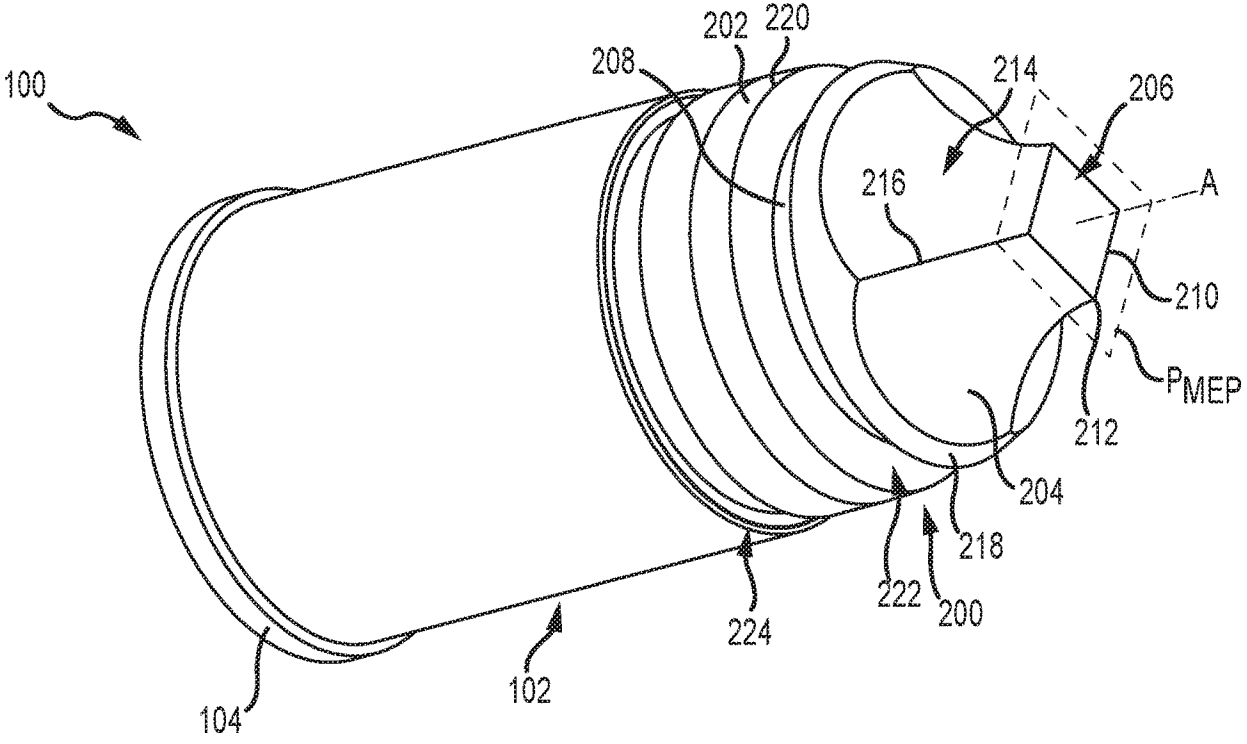
FIG. 1A is a front perspective view of an embodiment of a cartridge utilizing an armor-piercing cavitation projectile.
Figure 1B:
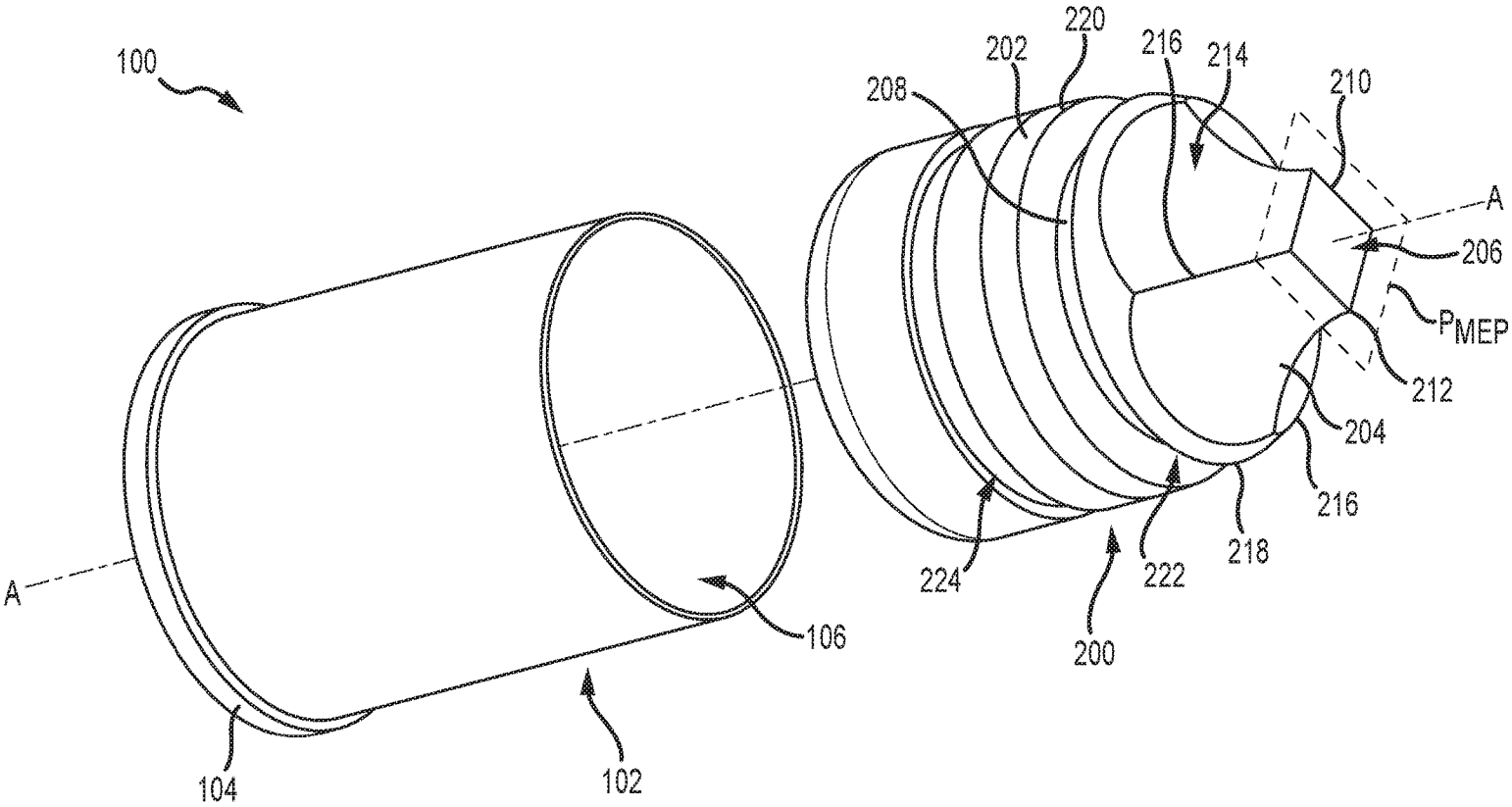
FIG. 1B is an exploded front perspective view of the cartridge of FIG. 1A.
Figure 1C:
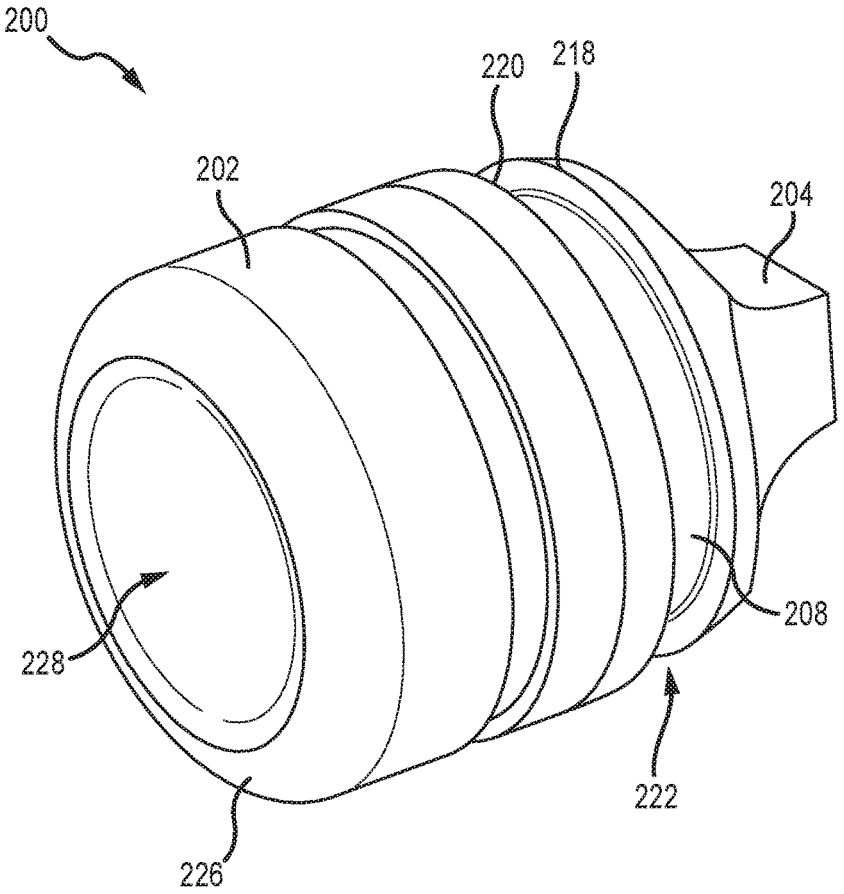
FIG. 1C is a rear perspective view of the projectile of FIG. 1B.

FIGS. 1A and 1B are front perspective and exploded front perspective views, respectively, of an embodiment of a cartridge 100 utilizing an armor-piercing cavitation projectile 200. These figures are described simultaneously, along with FIG. 1C, which depicts a rear perspective view of the armor-piercing cavitation projectile 200. The cartridge 100 includes an annular casing 102 having a primer (not shown) disposed at a first end 104 thereof, as well-known in the art. The casing 102 includes an open second end 106 into which the projectile 200 is inserted during manufacture and assembly. The interior of the casing 102 is filled with a propellant (e.g., gunpowder) that is ignited by the primer. This ignition discharges the projectile 200 from a firearm, such as a handgun. In so-called "automatic weapons," the force of the explosion is sufficient to both discharge the projectile and cycle a new cartridge into the weapon's firing chamber. The projectile 200 includes a body 202 and a nose 204. The nose 204 terminates at a meplat 206 of the projectile 200. The meplat 206 is the generally flat leading surface of the projectile 200 that defines a meplat plane $P_{MEP}$, which is substantially orthogonal to an axis A of the projectile 200. In the depicted example, the body 202 is connected to the nose 204 by a neck 208. Further details of the body 202, nose 204, meplat 206, and neck 208 are described herein.

Meplats are typically formed in a shape similar to that of the body of a projectile, e.g., substantially circular. In a radical departure from known projectiles, the meplat 206 of the present projectile 200 defines a substantially angular shape, with corners and straight or curved sides. More specifically, the meplat 206 depicted is bounded by a perimeter edge having substantially straight sides 210 intersecting at corners 212. More specifically, the perimeter edge of the depicted meplat 206 is substantially square. As described above, these straight sides 210 and sharp corners 212 reduce the hoop stress of objects that the projectile 200 impacts, thus increasing barrier resistance of the projectile 200. Other meplat configurations are contemplated. Exemplary meplats may be bounded by perimeters having shapes that are substantially triangular, pentagonal, hexagonal, and so on. Such shapes have an equal number of substantially straight sides and corners. Perimeters having virtually any number of straight sides and corners may be utilized with the present technology, but the greater the number of sides, the more the meplat begins to resemble a circle, and the effect on hoop stress becomes less pronounced. As such, a meplat having a lower number of sides and corners is desirable. Moreover, the sides need not be of the same length, although symmetry may be desirable to ensure even weighting of the projectile and true flight. Additionally, although the sides about the meplat 206 are depicted as straight, sides that curve inward toward the axis A may be particularly desirable, since corners having sharper angles may be formed where the curved sides meet, further reducing barrier material hoop stress.

The nose 204 extends from the meplat 206 (which forms the end thereof) towards the body 202. The nose 204 is in the shape of a frustum having a plurality of surfaces 214, typically a number of surfaces 214 equal to the number of sides 210 bordering the meplat 206. The surfaces 214 may be straight or curved, as depicted. If curved, the frustum surfaces 214 may be such that the surfaces 214 intersect the meplat plane $P_{MEP}$ at an angle substantially orthogonal thereto. The frustum surfaces 214 intersect at intersection curves 216 that further improve penetration of barriers. A curved frustum 204, such as that depicted, generates large amounts of hydraulic force when the projectile 200 hits a so-called "wet target." Wet targets include, for example, animals and persons, as well as water (in discharge testing tanks), and gel ordnance test blocks. As the projectile 200 moves forward within a wet target, fluid (water, blood, etc.) that contacts the frustum surfaces 214 travels along the surfaces 214 from the meplat 206 towards a collar 218 of the nose 204. More accurately, as the projectile 200 moves forward in the wet target, fluid that is within the path of travel of the projectile 200 is thrown violently outward due to hydraulic pressure as that fluid reaches the portions of the surfaces 214 proximate the collar 218. The fluid is ejected away from the axis A by a strong hydraulic force. As such, the fluid is projected substantially radially outward from the axis A of the projectile 200, creating a larger wound cavity and resulting in a cleaner kill.

The neck 208 connects the nose 204 to the body 202 and is defined by having a reduced diameter, as compared to a widest portion of the nose 204 (the collar 208) and the smallest portion of the body 202 (a trailing groove edge 220). The reduced diameter of the neck 208 forms a cavitation groove 222 in the outer surface of the projectile 200, which acts as an air reservoir as the projectile 200 enters a wet target. Air contained within the cavitation groove 222 as the projectile 200 enters a wet target may be drawn around the body 202 as the projectile 200 moves forward within the target. Thus, a cavitation groove 222 having a larger volume may contain more air that may envelope the body 202. The cavitation groove 222 between the nose 204 and the body 202 is significantly larger (with regard to both length and depth) than the grooves typically present on known projectiles. Those known, smaller grooves may be pressure relief grooves (that hold lubricant) and/or cannelures (locations where the casing is crimped onto the projectile). Pressure relief grooves and/or cannelures are depicted in the present projectile at 224 and the size difference between these grooves and the cavitation groove 222 is marked.

The body 202 forms the rear portion of the projectile 200 and contains the majority of the mass of the projectile 200. As described above, one or more pressure relief grooves or cannelures 224 may be defined therein. The body 202 includes a generally flat body tail surface 226, which may have defined therein a convex cavitation recess 228 at least partially defined by the body tail surface 226. The cavitation recess 228, if present, acts as a reservoir for air as the projectile enters a wet target, similar to the cavitation groove 222, described above.

Figure 2:
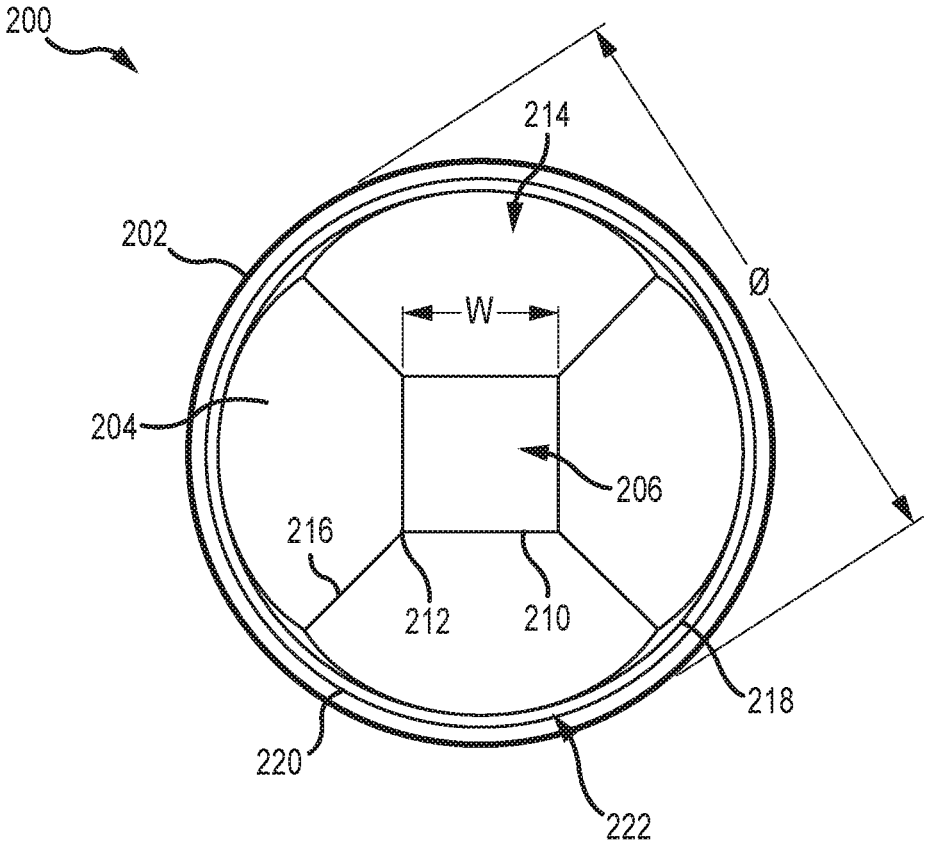
FIG. 2 is a meplat end view of the projectile of FIG. 1C.
Figure 3:
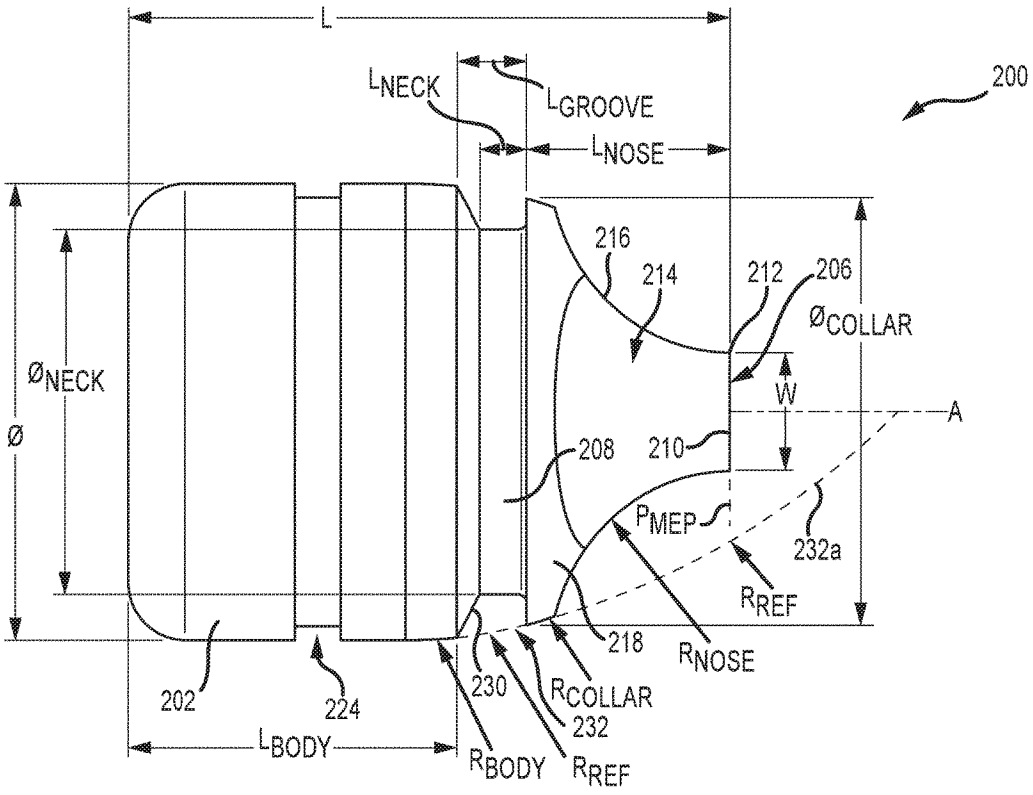
FIG. 3 is a first side view of the projectile of FIG. 1C.
Figure 4:
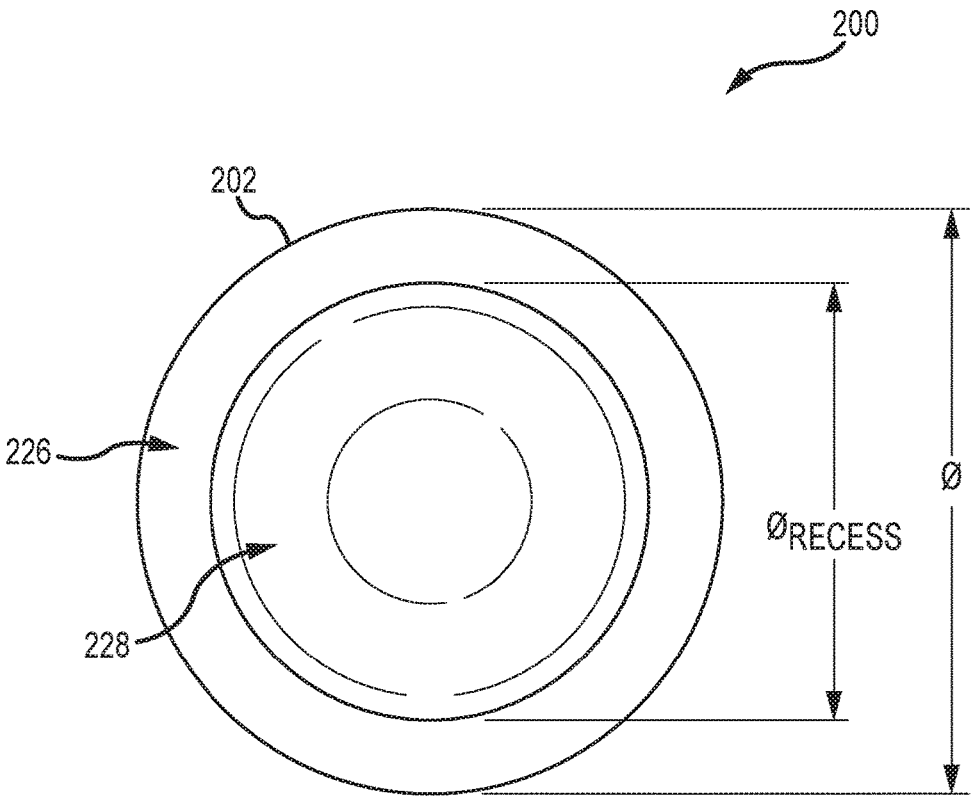
FIG. 4 is a tail end view of the projectile of FIG. 1C.

FIGS. 2-4 depict three orthogonal views of the projectile 200 described above, and are described generally simultaneously. A number of components and features of the projectile 200 are described above with regard to FIGS. 1A-1C and, as such, not all components and features are therefore further described below. The projectile 200 includes a total projectile length L that may be further divided into three primary of lengths along the axis A. For example, the nose 204 has a nose length LNOSE, the groove 222 has a groove length LGROOVE, and the body 202 has a body length LBODY. The groove length LGROOVE is longer than a length LNECK of the neck 208, which is measured from the collar 218 to a transition 230. The lengths of the various components described above can be as required or desired for a particular projectile. In one example, projectiles having a caliber of .355, for automatic and semi-automatic handguns, can have a nose length LNOSE of about 20% to about 40% of the total length L, or about 25% to about 35% of the total length L. In certain examples, the LNOSE can be about 27.5% of the total length L. Such a nose length LNOSE allows a cartridge using such a projectile to be properly loaded in automatic and semi-automatic firearms. Groove lengths LGROOVE greater than about 10%, about 15%, and about 20% of the total length L are contemplated, which differentiates the cavitation grooves 222 from the pressure relief grooves or cannelures 224 present on the projectile 200, as well as in the prior art. Indeed, it is common for pressure relief grooves or cannelures in the prior art to have a length of no more than about 8% of the total length of a projectile cavitation groove length. For example, $L_{GROOVE}$ projectiles manufactured as described herein can be about 11.5% or about 15.5%, double the length of pressure relief grooves and cannelures. Another distinguishing feature of the cavitation groove 222, as compared to the pressure relief grooves or cannelures 224 present on the projectile 200, the presence of the transition 230 within the groove 222, which helps the air present in the groove 222 to evacuate the groove 222 while in a wet target, thus enveloping the body 202. This is unlike known pressure relief grooves or cannelures, which form a ring having walls substantially orthogonal to an axis of a projectile. Indeed, the pressure relief grooves or cannelures 224 present on the projectile 200 display such straight walls.

The meplat 206 in the depicted projectile has a square edge 210, with each side having a width W of about 5% to about 30% of the maximum diameter ϕ (e.g., the caliber). A small width W can affect the robustness of the nose 204, which may become bent proximate the meplat 206 if the projectile 200 is struck prior to loading in a weapon. As such, slightly wider width W, such as between about 20% to about 25% or higher may be desirable. In example projectiles, a width W of about 21% or about 26% may be desirable. Moving away from the meplat 206 along the axis A, the collar 218 may have a diameter $\phi_{COLLAR}$ that may be directly related to a radius of curvature of the body $R_{BODY}$, and is therefore discussed below. The neck 208 may have a diameter as small as possible (to increase the volume of the groove 222), while remaining thick enough to prevent bending of the neck 208. In examples, the neck diameter $\phi_{NECK}$ may be at least about one-half the diameter ϕ of the projectile 200. Neck diameters $\phi_{NECK}$ between about 50% to about 80% of the total diameter ϕ are contemplated, as these help form a cavitation groove 222 having significant volume, while maintaining resistance to deformation. Neck diameters $\phi_{NECK}$ of about 56% and about 80% of the total diameter ϕ may be particularly desirable. This is significantly deeper than pressure relief groove or cannelure diameters, which can be about 90% of the projectile caliber. A neck diameter $\phi_{NECK}$ of about 80% of the collar diameter $\phi_{COLLAR}$ may also be desirable. Similarly, a high volume cavitation recess 228 is also desirable to entrain sufficient air.

A number of radii also further define the performance of the projectile 200. The body 202 includes a body radius $R_{BODY}$ that terminates at the transition 230. Notably, however, a reference curve 232 extends from the body 202 to the collar 218, thus spanning the groove 222. The reference curve 232 has a reference curve radius $R_{REF}$ identical to the body radius $R_{BODY}$. The collar 218 includes a collar radius $R_{COLLAR}$ identical to the body radius $R_{BODY}$ (and therefore the reference curve radius $R_{REF}$). As such, the collar diameter $\phi_{COLLAR}$ is measured at the intersection with the reference curve 232. From the collar 218, the reference curve 232 continues as tip reference curve 232*a*, maintaining the same reference curve radius $R_{REF}$ so as to intersect the axis A. As such, the nose 204 is contained within the reference curve 232, 232*a*. The surfaces 214 on the nose 204 also define a nose curvature $R_{NOSE}$ that forces fluid present in a wet target outward so as to create a wound cavity significantly larger than that of the projectile diameter ϕ.

The armor-piercing cavitation projectile described herein may be manufactured as monolithic solid copper or brass. Other acceptable materials include copper, copper alloy, copper-jacketed lead, copper-jacketed zinc, copper-jacketed tin, powdered copper, powdered brass, powdered tungsten matrix, steel, stainless steel, aluminum, tungsten carbide, and like materials. The narrow width W and angular configuration of the meplat 206 enables the projectile 200 to penetrate hard surfaces during flight. Thus, the projectiles described herein are barrier-blind to hide, hair, bone, clothing, drywall, car doors, etc. Barriers that would destroy a lead or lead-core projectile are easily breached with a projectile manufactured as described herein.

The various dimensions of the components described above may be modified as required or desired for a particular application. Certain ratios have been discovered to be particularly beneficial to ensure significant cavity formation during contact with a wet target as well as to ensure proper feeding from a magazine of an automatic weapon. Other geometric relationships are contemplated and are described below. The dimensions of the various portions of the disclosed projectiles assist in enabling those projectiles to function properly when penetrating barriers and hitting a wet target.

Example 1

Figure 5A:
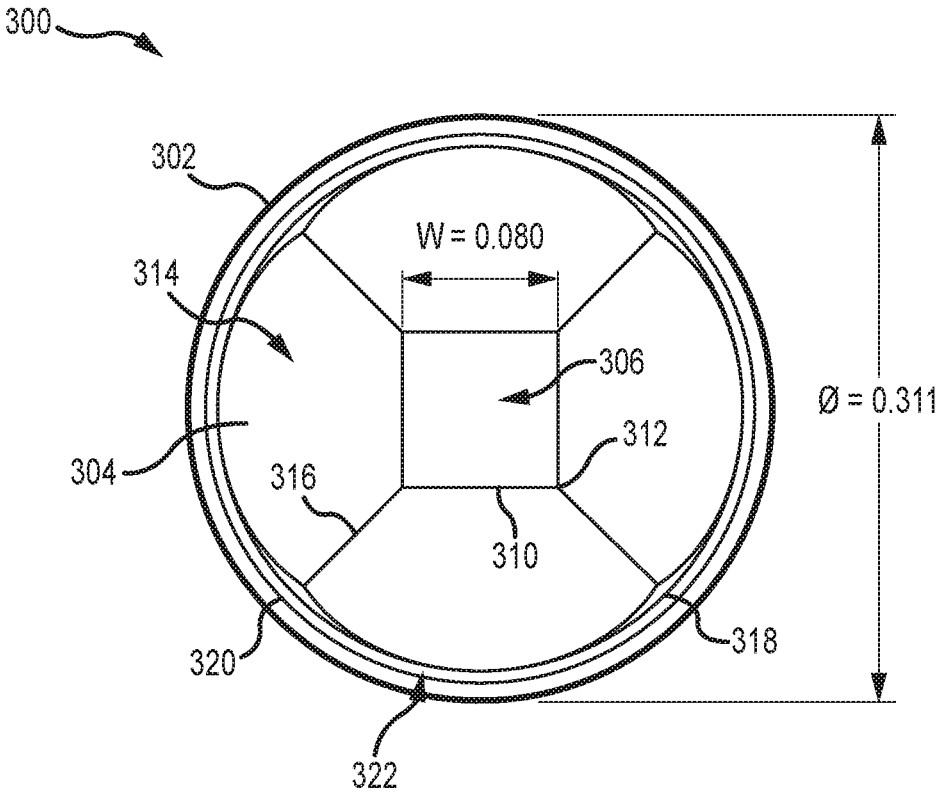
FIGS. 5A-5C depict various views of another example of an armor-piercing cavitation projectile.
Figure 5B:
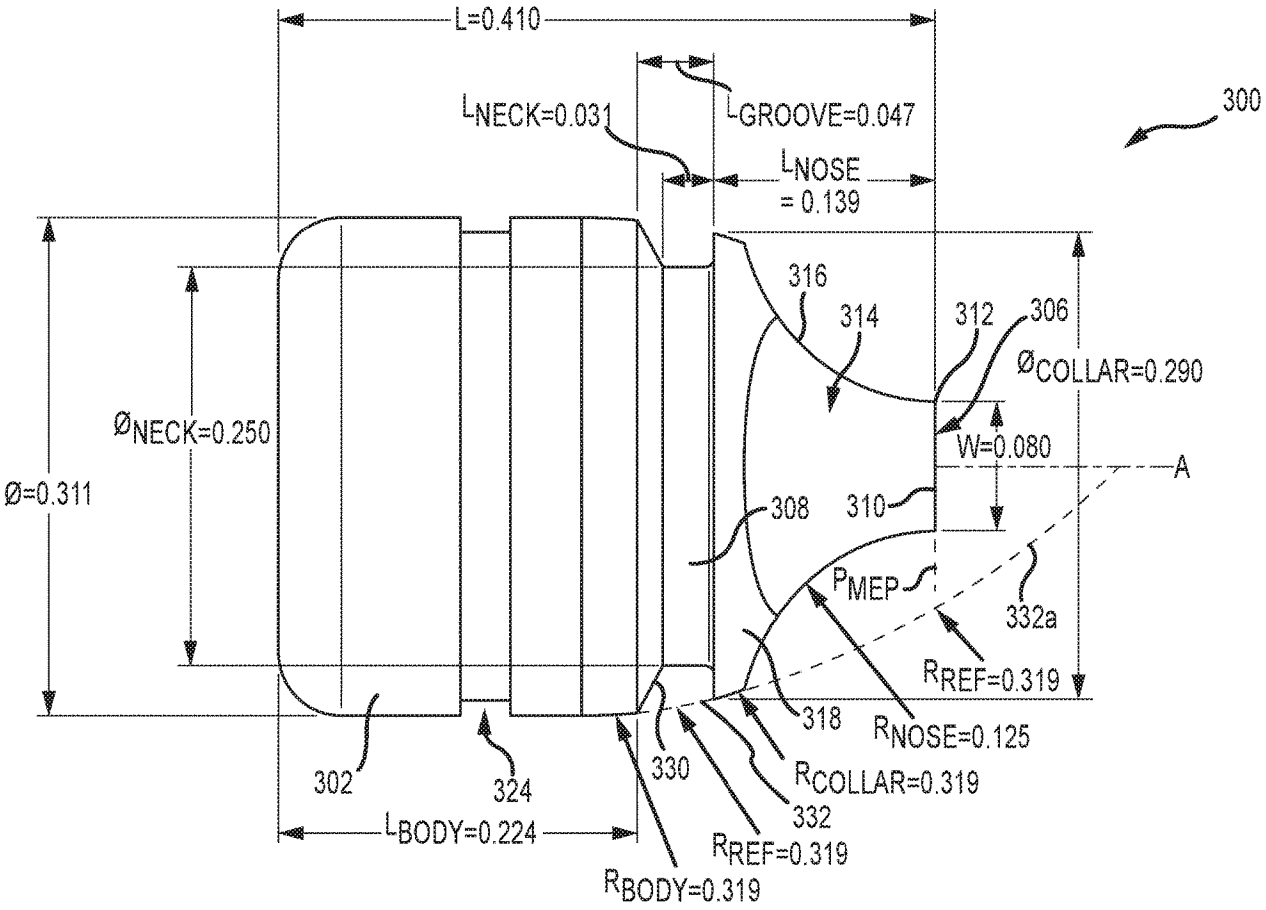
Figure 5C:
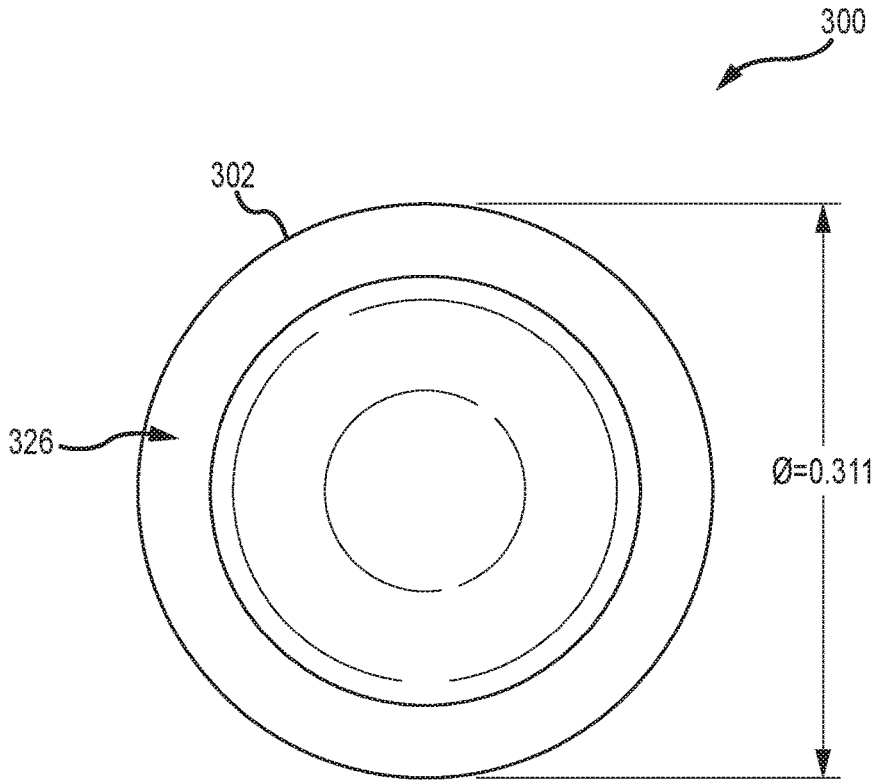

An example projectile consistent with the technologies described herein is presented in FIGS. 5A-5C. The reference numerals utilized in FIGS. 5A-5C are consistent with those depicted above. Accordingly, those elements are generally not necessarily described further. The projectile 300 is manufactured to the following specifications, identified in Table 1 below. Manufacturing tolerances are not reflected in the figures or Table 1.

TABLE 1

EXAMPLE 1 DIMENSIONS

| Dimension | Inches (unless noted) |
|---|---|
| Projectile Length, L | 0.410 |
| Nose Length, $L_{NOSE}$ | 0.139 |
| Groove Length, $L_{GROOVE}$ | 0.047 |
| Neck Length, $L_{NECK}$ | 0.031 |
| Body Length, $L_{BODY}$ | 0.224 |
| Projectile Diameter (Caliber), Ø | 0.311 |
| Collar Diameter, $Ø_{COLLAR}$ | 0.290 |
| Neck Diameter, $Ø_{NECK}$ | 0.250 |
| Recess Diameter, $Ø_{RECESS}$ | N/A |
| Meplat Width, W | 0.080 |
| Nose Surface Radius, $R_{NOSE}$ | 0.125 |
| Body Radius, $R_{BODY}$ | 0.319 |
| Collar Radius, $R_{COLLAR}$ | 0.319 |
| Reference Curve Radius, $R_{REF}$ | 0.319 |

The projectile described in accordance with EXAMPLE 1 was discharged from a weapon into a 10% ordnance gelatin test block. The results of this test are presented below.

Test Summary:

A 50 gr projectile (as described in EXAMPLE 1) was used. The projectile was fired utilizing a 32 ACP cartridge from a handgun having a barrel length of 2.7".

Projectile Specification:

| | |
|---|---|
| Weight | 50 gr |
| Length | 0.410" |

Ordnance Gel Specification:

The projectile was discharged into a 10% ballistic ordnance gelatin test block manufactured and calibrated in accordance with the FBI Ammunition Testing Protocol, developed by the FBI Academy Firearms Training Unit. The base powder material utilized for the 10% ordnance gelatin test block was VYSE™ Professional Grade Ballistic & Ordnance Gelatin Powder available from Gelatin Innovations, of Schiller Park, Ill. The block was manufactured at the test site in accordance with the formulations and instructions provided by the powder manufacturer. After manufacture of the gelatin test block, the test block was calibrated. Calibration requires discharging a 0.177 steel BB at 584 feet per second (fps), plus or minus 15 fps, into the gelatin test block. The test block is considered calibrated if the shot penetrates 8.5 centimeters (cm), plus or minus 1 cm (that is, 2.95 inches-3.74 inches). The calibrated block is then used in the terminal performance testing of the projectile.

Terminal Performance Testing:

| | | |
|---|---|---|
| Shot Velocity | 875 | fps |
| Temporary Cavity (TC) Length | 9.5" | approximate |
| TC Max. Diameter | 1.1" | approximate |
| Length of TC at Max. Diameter | 2.3" | approximate |
| Maximum Penetration Depth | 13.5" | approximate |
| Projectile Weight Retained | 50 | gr |

As can be seen, the maximum penetration depth of 13.5" is significantly higher than an expanding projectile fired from a 32 ACP cartridge, which has a typical penetration depth of about 8". Moreover, the temporary cavity of the tested projectile is over three times the projectile diameter, due to hydraulic forces caused by the expulsion of fluid away from the axis. This is significantly greater than the temporary cavity formed by a non-expanding, round nose projectile which forms a wound cavity smaller than the projectile diameter, due to elasticity of the gel. The projectile, when utilized in a cartridge having an appropriate casing and primer, can be fed from a magazine of virtually any capacity, in both automatic and semi-automatic weapons. A sabot may be utilized if required or desired, but the geometry of the projectile enables a cartridge utilizing the projectile to properly load.

Example 2

Figure 6A:
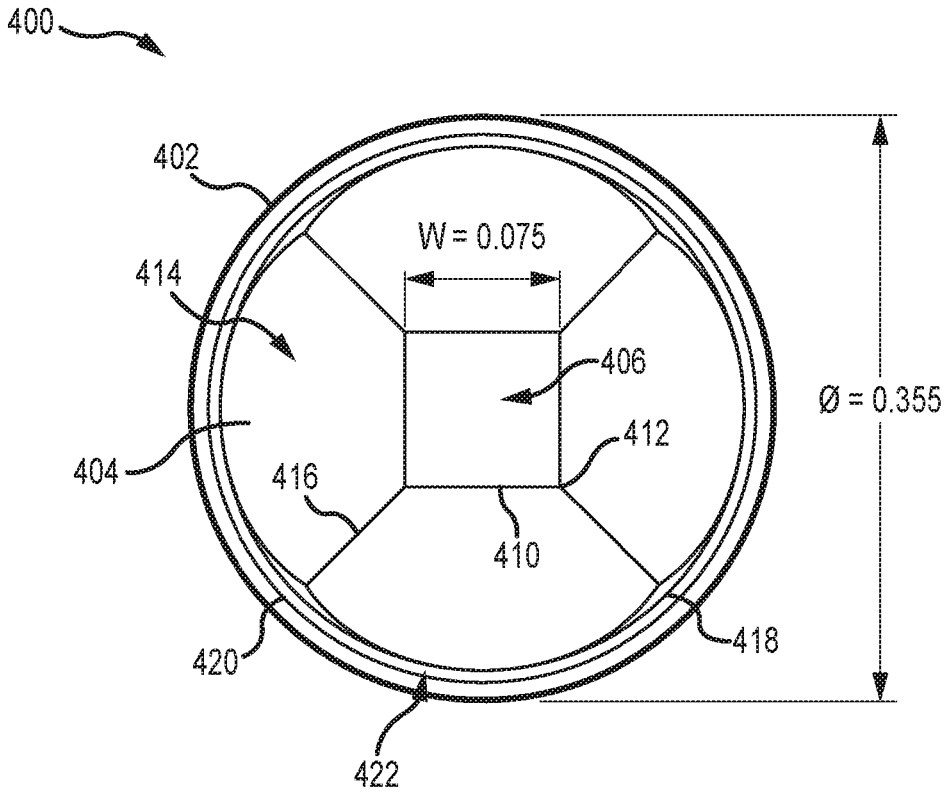
FIGS. 6A-6C depict various views of another example of an armor-piercing cavitation projectile.
Figure 6B:
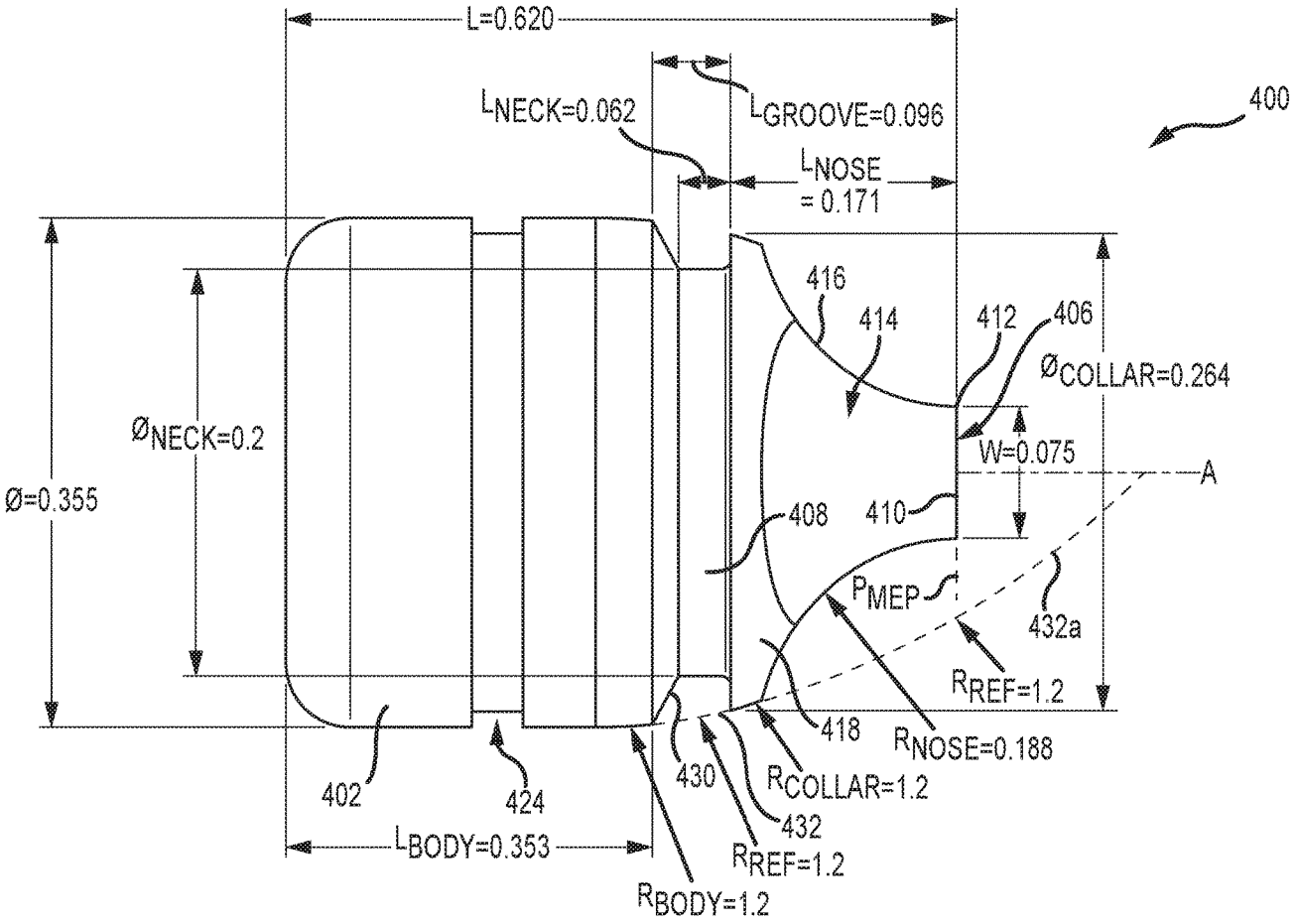
Figure 6C:
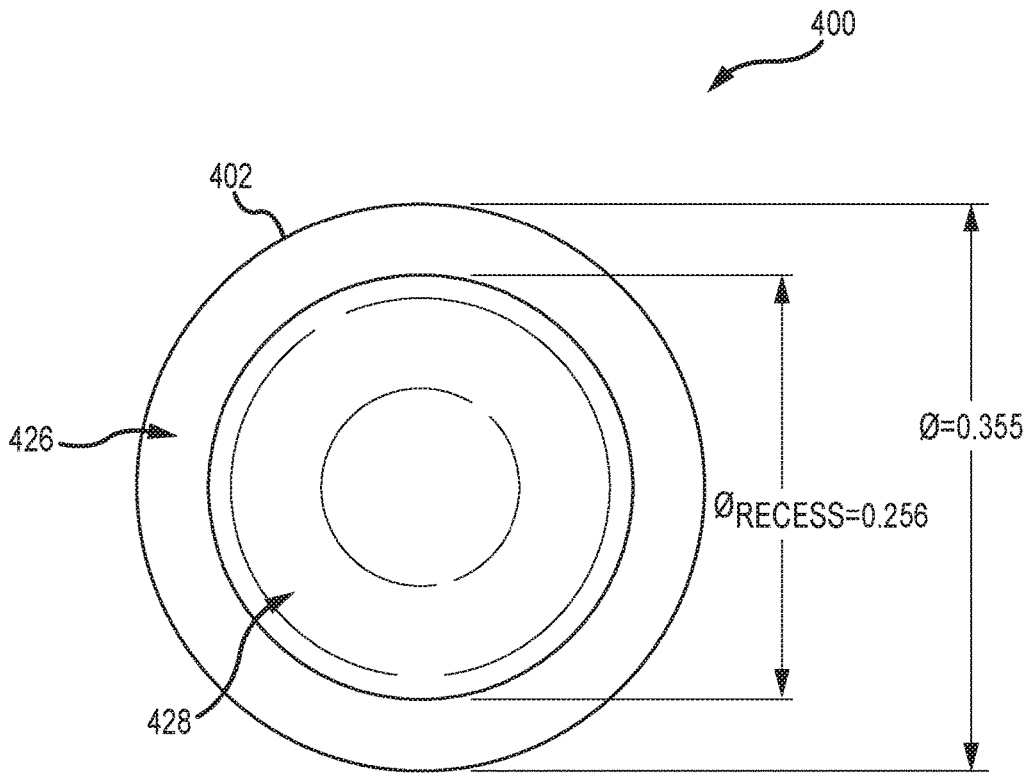

Another example projectile, a .355 caliber projectile, consistent with the technologies described herein is presented in FIGS. 6A-6C. The reference numerals utilized in FIGS. 6A-6C are consistent with those depicted above. Accordingly, those elements are generally not necessarily described further. The projectile 400 is manufactured to the following specifications, identified in Table 2 below. Although tests results for the projectile 400 are not provided, the features and dimensions are consistent with the present description. As such, performance is predicted to be consistent with that presented above with regard to Example 1.

TABLE 2

EXAMPLE 2 DIMENSIONS

| Dimension | Inches (unless noted) |
|---|---|
| Projectile Length, L | 0.620 |
| Nose Length, $L_{NOSE}$ | 0.171 |
| Groove Length, $L_{GROOVE}$ | 0.096 |

TABLE 2-continued

EXAMPLE 2 DIMENSIONS

| Dimension | Inches (unless noted) |
|---|---|
| Neck Length, $L_{NECK}$ | 0.062 |
| Body Length, $L_{BODY}$ | 0.353 |
| Projectile Diameter (Caliber), Ø | 0.355 |
| Collar Diameter, $Ø_{COLLAR}$ | 0.269 |
| Neck Diameter, $Ø_{NECK}$ | 0.2 |
| Recess Diameter, $Ø_{RECESS}$ | 0.256 |
| Meplat Width, W | 0.075 |
| Nose Surface Radius, $R_{NOSE}$ | 0.188 |
| Body Radius, $R_{BODY}$ | 1.2 |
| Collar Radius, $R_{COLLAR}$ | 1.2 |
| Reference Curve Radius, $R_{REF}$ | 1.2 |

Manufacture of projectiles consistent with the technologies described herein may be by processes typically used in the manufacture of other projectiles. The projectiles may be cast from molten material, or formed from powdered metal alloys. Projections in the mold may form the curved surfaces and nose. Alternatively, the grooves and or surfaces may be cut into the projectiles after casting. The projectiles, casings, primers, and propellants may be assembled using one or more pieces of automated equipment.

Unless otherwise indicated, all numbers expressing dimensions, speed, weight, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present technology.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents that may otherwise be afforded a particular value. Further, unless otherwise stated, the term "about" shall expressly include "exactly," consistent with the discussions regarding ranges and numerical data. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. This same principle applies to ranges reciting only one numerical value. Furthermore, such an interpretation should apply regardless of the breadth of the range or the characteristics being described.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A projectile comprising:

a body having an axis;

a nose comprising a frustum and a meplat disposed substantially orthogonal to the axis and along a meplat plane, wherein the meplat is bounded by a substantially square perimeter edge, and wherein the frustum comprises four curved surfaces extending from the meplat, each of the four curved surfaces intersects the meplat plane at a substantially orthogonal angle, and each of the four curved surfaces intersects one another at an intersection curve; and a substantially round collar, wherein each of the four curved surfaces terminates at the collar.

2. The projectile of claim 1, wherein the body comprises a body tail surface disposed opposite the meplat, and wherein the nose extends from the meplat towards the body tail surface.

3. The projectile of claim 1, wherein the body comprises a body ogive radius and the collar comprises a collar ogive radius substantially the same as the body ogive radius.

4. The projectile of claim 1, the body further comprising a neck disposed between the collar and the body, wherein the neck comprises a diameter less than a diameter of the collar.

5. The projectile of claim 4, wherein the body defines a groove reference curve spanning from the body to the collar, wherein the groove reference curve is identical to the body ogive radius.

6. A projectile comprising:

a body;

a nose formed monolithically with the body, wherein the nose comprises a frustum and a meplat, wherein an outer edge of the meplat is at least partially defined by a plurality of corners having a plurality of straight sides extending therebetween, wherein the frustum comprises a plurality of curved surfaces, and each of the plurality of curved surfaces extends from a respective straight side of the plurality of straight sides, wherein each of the plurality of curved surfaces intersects the meplat at a substantially orthogonal angle, and wherein each of the plurality of curved surfaces intersects one another at an intersection curve that extends from a respective corner of the plurality of corners; and a collar, wherein each of the plurality of curved surfaces terminates at the collar.

7. The projectile of claim 6, wherein the frustum comprises four curved surfaces extending from the meplat.

8. The projectile of claim 6, wherein an outer edge of the collar is at least partially defined by a circular outer edge.

9. The projectile of claim 6, wherein the projectile comprises a total projectile length and the nose comprises a nose length of about 25% to about 35% of the total projectile length.

10. The projectile of claim 9, wherein the nose length is about 27.5% of the total projectile length.

11. The projectile of claim 9, further comprising a neck connecting the body and the nose, and wherein the body and the nose define a groove substantially surrounding the neck.

12. The projectile of claim 11, wherein the neck comprises a neck length of at least about 10% of the total projectile length.

13. A projectile comprising:

an axis;

a total projectile length measured along the axis;

a nose comprising a collar, a frustum, and a meplat, wherein the frustum comprises a plurality of curved surfaces, and each of the plurality of curved surfaces intersects the meplat at a substantially orthogonal angle and terminates at the collar, and wherein each of the plurality of curved surfaces intersects one another at an intersection curve that extends between the meplat and the collar;

a body having a body tail surface, wherein the body and the nose are monolithic; and a neck connecting the nose and the body, wherein the neck comprises a neck diameter of about 80% of a diameter of the collar, and wherein the nose and the body define a groove therebetween wherein the groove comprises a groove length of at least about 10% of the total projectile length.

14. The projectile of claim 13, wherein the meplat has an angular outer edge.

15. The projectile of claim 13, wherein the body comprises a body ogive radius and defines a reference curve spanning the groove, wherein the reference curve further extends from the collar to the axis, and wherein the reference curve comprises a reference curve radius identical to the body ogive radius.

16. The projectile of claim 15, wherein the nose is substantially contained within the reference curve.

17. The projectile of claim 15, wherein the nose is contained within the reference curve.

18. The projectile of claim 13, wherein the body tail surface at least partially defines a concave recess.

* * * * *